United States Patent [19]

Moji

[11] Patent Number: 4,504,325

[45] Date of Patent: Mar. 12, 1985

[54] METHOD FOR SEALING AN ALUMINUM OXIDE FILM

[75] Inventor: Yukimori Moji, Seattle, Wash.

[73] Assignee: The Boeing Company, Seattle, Wash.

[21] Appl. No.: 359,853

[22] Filed: Mar. 19, 1982

[51] Int. Cl.[3] ..... C23F 7/06

[52] U.S. Cl. ..... 148/6.2; 148/6.14 R; 148/6.27

[58] Field of Search ..... 148/6.2, 6.27, 6.14 R

[56] References Cited

U.S. PATENT DOCUMENTS

| | | | |
|---|---|---|---|
| 1,946,151 | 2/1934 | Edwards | 148/6.27 |
| 1,965,269 | 7/1934 | Tasterud | 148/6.27 |
| 2,045,286 | 6/1936 | Tosterud | 148/6.27 |
| 2,288,007 | 6/1942 | Lum | 148/6 |
| 2,544,139 | 3/1951 | Deyrup et al. | 148/6.2 |
| 2,563,431 | 8/1951 | Spruance, Jr. | 148/6.16 |
| 2,564,864 | 8/1951 | Thompson | 148/6.16 |
| 2,678,291 | 5/1954 | Spruance, Jr. et al. | 148/6.16 |
| 2,784,122 | 3/1957 | Cox et al. | 148/6.2 |
| 2,843,513 | 7/1958 | Stricklen | 148/6.2 |
| 2,894,865 | 7/1959 | Pryor | 148/6.16 |
| 2,899,368 | 8/1959 | Spooner | 204/35 |
| 2,987,417 | 6/1961 | Cochran | 148/6.27 |
| 3,032,435 | 5/1962 | Michel | 148/6.27 |
| 3,096,220 | 7/1963 | Dalrymple et al. | 148/6.2 |
| 3,113,051 | 12/1963 | Pimbley et al. | 148/6.2 |
| 3,183,125 | 5/1965 | Bjork | 148/6.2 |
| 3,257,244 | 6/1966 | Barkman | 148/6.2 |
| 3,347,713 | 10/1967 | Lodeesen et al. | 148/6.2 |
| 3,364,080 | 1/1968 | Hall | 148/6.2 |
| 3,414,489 | 12/1968 | Rogers | 148/6.27 |
| 3,832,239 | 8/1974 | Hoch et al. | 148/6.2 |

OTHER PUBLICATIONS

Chemical Abstract, vol. 67, 1967, 46509j.

*Primary Examiner*—Norman Morgenstern
*Assistant Examiner*—Janyce A. Bell
*Attorney, Agent, or Firm*—Christensen, O'Connor, Johnson & Kindness

[57] ABSTRACT

The corrosion resistance and coating adhesion characteristics of an aluminum oxide film produced by anodization is improved by contacting the film with a dilute aqueous solution of an oxidizing composition, for example chromic acid, and a pH altering substance that maintains the pH of the solution between 3.0 and 5.0. Exemplary pH altering compositions are respectively chromic acid and sodium or magnesium chromate.

19 Claims, No Drawings

METHOD FOR SEALING AN ALUMINUM OXIDE FILM

BACKGROUND OF THE INVENTION

The present invention relates to a method for sealing a porous aluminum oxide film formed on an aluminum substrate, and more particularly, to a method for improving the corrosion resistance and organic coating adhesion characteristics of an aluminum oxide film produced by anodization.

Aluminum alloys used in aircraft and other lightweight structures are highly susceptible to corrosion, especially in a saline environment. A common way to prepare aluminum alloys to protect them from corrosion is to form an aluminum oxide layer on the surface of the alloy by anodizing the alloy in the presence of an acid. For example, after an aluminum alloy part has been cleaned, rinsed and deoxidized, the metal part is anodized in an electrolyte solution containing on the order of 5% by weight of chromic acid. The anodization is carried out at potentials ranging from 22 to 60 volts for periods on the order of 30 to 60 minutes at temperatures around 95° F. The aluminum oxide thus formed still does not provide good resistance to corrosion because it is very porous. Thus, the aluminum oxide layer must be sealed to prevent corrosive media such as sodium chloride from penetrating through the aluminum oxide layer to the base metal.

A variety of methods for sealing aluminum oxide layers so formed have been developed. Examples of some of the prior methods include contacting the aluminum oxide layer with a hot sealing bath comprising deionized water, an aqueous solution of dichromate ions, nickel acetate, a strong aqueous solution of chromic acid and sodium tungstate, or a dilute aqueous solution of chromic acid. These sealing methods involve at least in part the conversion of the outer surface of the aluminum oxide layer to aluminum oxide monohydrate. Although the mechanism is not completely understood, the resulting porous surface of the aluminum oxide is sufficiently sealed to prevent the incursion of corrosive media. While the foregoing methods do accomplish the objectives of sealing the aluminum oxide layer, most are difficult to control, and thus achieve varying degrees of corrosion resistance. In addition, many times it is difficult to obtain good adherence of an organic coating, such as an epoxy paint or primer, to a sealed aluminum oxide surface that effectively resists corrosion in a saline environment.

For example, when a hot deionized water sealing bath is employed, it is difficult to control the degree of hydration of the oxide and thus the degree of corrosion protection provided by the sealed anodized layer. Satisfactory corrosion resistance in a saline environment can be achieved by increasing the amount of hydration to on the order of 15 percent or more, thus sealing the porous oxide. However, this extent of hydration forms a cohesively weak oxide, and thus significantly degrades adhesion of organic coatings to be sealed surface. The chromic acid/chromium tungstate sealing process was developed primarily for aluminum oxide layers that are anodized in the presence of a sulfuric acid bath to provide a colorless coating. Additionally, the process is conducted at a relatively high pH, on the order of 6.0, which tends to form a cohesively weak oxide. Although sealing in the presence of a dilute chromic acid solution having a relatively low pH tends to provide a surface to which organic coatings will adhere at least to a certain extent, the process has not met with great success because the corrosion resistance of the product in a saline environment is generally not satisfactory. Sealing in the presence of a 5% by weight sodium or potassium dichromate has been considered a viable alternative to sealing in the presence of deionized water, the method currently being used. However, sealing in the presence of dichromate ion requires a separate rinsing operation after the sealing step. This additional step greatly increases the expense of forming the corrosion resistant coating. Moreover, it has been found that sealing in the presence of dichromate ion does not provide organic coating adhesion as good as desired.

SUMMARY OF THE INVENTION

The present invention therefore provides a method for sealing a porous aluminum oxide film formed on an aluminum surface that yields a product exhibiting excellent corrosion resistance in a saline environment while still providing consistently good adhesion of organic coatings. The method comprises contacting the aluminum oxide film with a dilute aqueous sealing solution comprising an oxidizing composition selected from the group consisting of chromic acid, molybdic acid, ammonium or alkali metal chromate, ammonium or alkali metal vanadate, ammonium or alkali metal tungstate, ammonium or alkali metal molybdate, or mixtures thereof and a pH altering composition that maintains the pH of the solution in the range of from 3.0 to 5.0. When the preferred oxidizing composition, chromic acid, is employed, the pH altering composition is selected from the group consisting of a base, a buffering composition or mixtures thereof. The film is contacted with this solution for a predetermined time while the solution is maintained within a predetermined temperature range. When the most preferred pH altering compositions, magnesium or sodium chromate, are employed, it is most preferred that the total amount of hexavalent chromium ion in the solution be maintained within the range of from 20 to 200 ppm.

DETAILED DESCRIPTION OF THE INVENTION

The aluminum oxide sealing method of the present invention is effective for producing a sealed aluminum oxide coating, whether that aluminum oxide layer is formed by anodization in the presence of chromic acid, anodization in the presence of sulfuric acid, or by other methods. It is especially effective for aluminum oxide anodized in the presence of chromic acid since thorough rinsing of the coating after anodization is not required. A typical aluminum oxide coating is prepared for sealing in accordance with the present invention by conventional processes. For example, the aluminum structure to be anodized and sealed is first vapor degreased and solvent cleaned. The part is then subjected to alkaline cleaning, a hot water rinse, aluminum deoxidizing and a cold water rinse. Thereafter, the part is anodized, for example, in a 3 to 5% by weight solution of chromic acid. The part can be anodized at conventional potentials, for example, 22 volts or 40 volts, or at other potential levels if desired. It is, of course, preferred that a minimum of about 200 milligrams per square foot of aluminum oxide coating be formed on the aluminum surface.

An anodized aluminum surface thus formed is sealed by contacting the aluminum oxide layer with a dilute aqueous sealing solution of an oxidizing acid or an oxidizing corrosion inhibitor, while carefully controlling the pH and temperature of the solution, the time during which the layer is immersed in the sealing solution, the level of certain undesirable soluble components and the overall level of soluble solids in this solution. In this manner, the degree of hydration, that is, the degree of sealing of the aluminum oxide layer, can be precisely controlled at a level that will not only provide excellent corrosion resistance in a saline environment, but will also provide an excellent substrate for adhesion of organic coatings, such as epoxy paints and primers. Suitable oxidizing acids include chromic acid and molybdic acid. Suitable oxidizing corrosion inhibitors include an ammonium or alkali metal chromate or dichromate, an ammonium or alkali metal vandate, an ammonium or alkali metal molybdate, or an ammonium or alkali metal tungstate.

While precise control of all of the parameters outlined above is necessary in order to obtain best results in accordance with the invention, the most important parameter to control is pH. The pH of the solution must be controlled within the range of from 3.0 to 5.0, the most preferred range being from 3.2 to 3.8. The pH is controlled in accordance with the present invention by the addition of a pH altering composition.

A preferred sealing solution comprises a dilute aqueous solution of chromic acid in which the pH is controlled by the addition of small amounts of a base, such as sodium hydroxide or ammonium hydroxide, or by the addition of small amounts of a buffering compound. Suitable buffering compounds include ammonium and alkali metal chromates, vanadates, molybdates and tungstates. When buffering compounds are employed, the pH of the sealing solution can be controlled within the range of from about 3.2 to about 4.0. When the most preferred buffering compounds, sodium or magnesium chromate are employed, the pH of the solution can be precisely controlled within the range of from about 3.2 to about 3.8.

The use of chromic acid and magnesium or sodium chromate are most desirable because these compounds give additional corrosion protection when small amounts of the salt becomes part of the anodized film during sealing. Because of its acid content, the sealing solution simultaneously hydrates and dissolves the anodize film. The dissolution causes the extent of hydration to be less than at comparable time and temperature conditions with deionized water or sodium dichromate seals. The pH, temperature of the sealing solution, and sealing time must be controlled to produce a partially sealed oxide (on the order of 5 to 10 percent hydration) that will provide optimum paint adhesion and corrosion protection.

When a weak oxidizing acid such as molybdic acid is employed as the oxidizing acid, the pH is controlled by addition of small amounts of a strong acid such as nitric acid. Also, when a dilute aqueous solution of oxidizing corrosion inhibitors including ammonium and alkali metal chromates or dichromates, vanadates, molybdates, tungstates or mixtures thereof is used as a sealing solution, the pH of the solution is controlled by addition of small amounts of nitric acid.

It is also important in order to achieve the desired results that the sealing solution be dilute and relatively pure, that is, the total amount of oxidizing acid corrosion inhibitor, pH altering composition and other dissolved solids must be present in the solution in an amount less than 500 ppm. It is preferred, however, that the acid be present in amounts ranging from 20 to 200 ppm and that the pH altering composition be present in amounts ranging from 20 to 200 ppm.

When chromic acid is employed as the oxidizing acid, the acid is preferably present in an amount ranging from 30 to 140 ppm (based on $CrO_3$), with the acid being present in an amount ranging from 60 to 120 ppm being most preferred. With these amounts of chromic acid, it is preferred that the buffering compounds be present in the range of from about 20 to 220 ppm and most preferably from about 25 to 100 ppm. The preferred manner of monitoring the amounts of the chromic acid and chromate buffering compound present is to monitor the amount of hexavalent chromium ion present in the solution. The hexavalent chromium ion can be present in the solution in amounts ranging from 20 to 200 ppm while still maintaining the pH within the broad range of 3.0 to 5.0. However, it is most preferred that the hexavalent chromium ion be present in amounts ranging from 45 to 100 ppm in order to maintain the pH within the range of from 3.2 to 3.8.

The temperature of the sealing solution must be maintained at a relatively high level, that is, in the range of from 160° F. to the boiling point of the solution. It is most preferred that the temperature of the sealing solution be maintained in the range of from 190° F. to 205° F. It has been found that the temperature of the sealing solution can be maintained slightly lower if the aluminum oxide layer is anodized at a relatively low potential level. For example, if the aluminum anodization is conducted at 22 volts, the sealing solution can be maintained in the temperature range of 190° to 200° F. However, an aluminum oxide layer anodized at 40 volts is better sealed at a bath temperature on the order of from 195° F. to 205° F. The time during which the aluminum oxide layer is contacted with the sealing solution is not critical. Contact time can range from 5 to 60 minutes without adverse effect on corrosion resistance or paint adhesion. However, the preferred degree of hydration in the oxide layer is obtained if the contact time falls in the range of from 20 to 30 minutes, and most preferably from 23 to 28 minutes.

If the temperature at which the aluminum is anodized is raised slightly higher than that now conventionally used, the temperature of the sealing solution can be lowered. For example, typical chromic acid anodization is conducted at 95° F. If, for example, the anodization is conducted at 105° F., the temperature of the sealing solution can be lowered from, for example, 200° F. down to 175° to 180° F. Similarly, it is believed that a lower sealing bath temperature can be utilized when anodization is conducted in the presence of sulfuric acid. In both instances, it is believed that the lower temperature of the sealing solution can still provide an effective seal because the aluminum coating that is formed at higher anodizing temperatures or in the presence of sulfuric acid is thicker than that formed with conventional chromic acid anodization.

Effective sealing of the aluminum oxide layer also requires that the level of silicone dioxide in the sealing solution not exceed 20 ppm, and preferably not exceed 10 ppm. Additionally, the total dissolved solids in the sealing solution must be maintained at a level below 500 ppm. The oxidizing acid and pH altering material present in the solution must be taken into account when calculating the total dissolved solids. Best results are obtained when the total disolved solids level is maintained below 250 ppm.

It has been found that by adjusting and controlling the sealing variables of time, temperature and pH in accordance with the present invention that an oxide structure with a cohesive strength greater than the strength of the adjacent primed surfaces can be formed. It can be demonstrated that sealing solutions having a relatively high pH, for example, sodium dichromate and hot deionized water yield sealed chromic acid anodized films with a duplex or triplex structure containing a weak cohesive interface. As the acid content of the sealing solutions formulated in accordance with the present invention is increased, that is, the pH lowered to within the acceptable ranges outlined above, the tendency to form cohesively weak structures is dramatically decreased. It has also been found that shorter sealing times and lower bath temperatures than those previously used will provide oxide layers that are cohesively strong.

EXAMPLES

The following examples are included to illustrate to one of ordinary skill how to make and use the invention. They are also intended to illustrate the advantages of the present invention. The examples are not in any way intended to narrow or otherwise limit the scope of protection granted by Letters Patent hereon.

EXAMPLE I

A plurality of test panels composed of 7075-T6 and 2024-T3 aluminum alloy were anodized in an electrolyte containing 4% by weight chromic acid at 22 volts and 95° F. for 30 minutes. A first sealing solution comprising 100 ppm $CrO_3$ solution was prepared. The sealing solution initially had a pH of 2.9. A pair of panels comprising a 7075 alloy panel and a 2024 alloy panel was sealed at a temperature of 180° F. for 15 minutes. Second and third pairs of panels were sealed in the same bath for 15 minutes at 190° F. and 200° F., respectively. This bath simulates the prior art bath disclosed in U.S. Pat. No. 3,414,489, issued to N. L. Rogers on Dec. 3, 1968.

The balance between the rate of hydrated oxide formation and the rate of oxide dissolution during the sealing process was determined by calculating the percentage of hydration of the anodic coating due to sealing as follows. The test panels are weighed following the anodizing treatment. The panels are then immersed in the sealing solution for the specified time and at the specified temperature. The sealed panels are then air dried and stored in a dessicator for a minimum of 15 minutes. The panels are then weighed again. The panels are then stripped in a chromic acid phosphoric acid solution in accordance with Section 4.6.1.1 of military specification MIL-A-8625C and weighed a third time. The percent of hydration is calculated by the following formula:

$$\text{Percent Hydration} = \frac{(\text{anodized and sealed weight}) - (\text{unsealed anodized weight})}{(\text{anodized and sealed weight}) - (\text{stripped weight})} \times 100$$

The percent hydration for each of the test panels is set forth in Table 1. The percent hydration for the 2024 and 7075 alloys was similar and is therefore jointly expressed in the table. The (−) symbol indicates weight loss, that is, an etching of the oxide.

Paint adhesion tests and salt spray corrosion tests were conducted on each of the panels thus sealed. The salt spray test was conducted by exposing the panels to a 5% aqueous sodium chloride fog at 95° F. for 336 hours in accordance with ASTM B117. The determination whether the panel passed or failed was made in accordance with military specification MIL-A-8625. The coating adhesion test, commonly referred to as a crazing test, was conducted by applying a thin coat, on the order of 1 to 2 mils, of a two-part epoxy fuel tank primer (equivalent to military specification MIL-C-27725) to each of the panels. After the primer is cured, an aluminum rod with ends rounded to 0.12 inch is scraped across the primed surface of the panel to score the primed surface while holding the rod at a 45° angle to the surface. If the primer is removed along a score path having a width greater than one-eighth inch, the adhesion of the primer to the test panel is termed a failure. If the width of the removal path is less than one-eighth inch, the adhesion is considered to pass, that is, is considered satisfactory. The results of this first series of tests are set forth in Table 1 below.

TABLE 1

| Sealing Solution | pH | Temperature (°F.) | Time (Min) | % Hydration | Coating Adhesion | 336 Hrs. Salt Spray 2024 −T3 | 336 Hrs. Salt Spray 7075 −T6 |
|---|---|---|---|---|---|---|---|
| 100 ppm | 2.93 | 180 | 15 | −5.4 | Pass | Fail | Fail |
| | to | 190 | 15 | +0.3 | Pass | Fail | Fail |
| $CrO_3$ | 3.1 | 200 | 15 | +5.7 | Pass | Marginal | Marginal |
| 100 ppm | 3.8 | 180 | 15 | +6.3 | Pass | Fail | Fail |
| | to | 190 | 15 | +8.4 | Pass | Fail | Fail |
| $CrO_3$ | 3.95 | 200 | 15 | +10.6 | Pass | Pass | Pass |
| Add NaOH to pH | | | | | | | |
| 100 ppm | 4.6 | 180 | 15 | +8.3 | Pass | Fail | Fail |
| | to | 190 | 15 | +14.8 | Fail | Pass | Pass |
| $CrO_3$ | 5.2 | 200 | 15 | +18.6 | Fail | Pass | Pass |

During the initial series of tests, which began with the panels that were sealed at 180° F. and progressed to those sealed at 200° F., the pH of the solution increased from about 2.9 to about 3.1. As shown by the results, all of the test panels passed the paint adhesion test but failed the salt spray corrosion test. The hydration was less than 6% for each of the panels.

A second set of test panels was again anodized for 15 minutes at 180° F., 190° F. and 200° F. The pH of the sealing solution was first raised to about 3.8 by the addition of sodium hydroxide. The pH of the bath increased from 3.8 to 3.95 during the series of the tests. The percent hydration was calculated. Coating adhesion tests and salt spray tests were then conducted on the panels. The results are set forth in Table 1. The results indicate that the percent hydration was increased as a result of the increase in pH of the sealing solution. The panels sealed at 200° F. having 10.6 percent hydration passed both the coating adhesion and the salt spray tests.

The pH of the bath was then adjusted to 4.6 by the addition of more sodium hydroxide. A third set of panels was sealed for 15 minutes at 180° F., 190° F. and 200° F. The degree of hydration was further increased at these higher pH levels. The panels sealed at 180° F., which achieved hydration of only 8.3%, passed the coating adhesion test but failed the salt spray test. Panels coated 190° F. and 200° F. passed the salt spray test but failed the coating adhesion test. Failure of the coating adhesion test is believed to be caused by the high degree of hydration, although the high degree of hydration increased the corrosion resistance.

The results of these first three series of tests indicates that the proper selection of pH, sealing temperature and time are essential to produce a sealed anodized film having both improved corrosion resistance and paint adhesion. When the pH value is permitted to fall below about 3.0, an abnormally high rate of dissolution of the anodic film occurs. As a result, the excellent corrosion protection obtained when the procedures are followed in accordance with the present invention will not be achieved. Conversely, when the pH value is permitted to rise above about 5.0, a cohesively weak oxide layer begins to be formed due to excessive hydration. Consequently, coatings will not satisfactorily adhere to such panels.

EXAMPLE II

Another series of panels composed of 2024-T3 and 7075-T6 aluminum alloys were prepared. Specimens of each of the panels were anodized in accordance with the conventional methods outlined in Example I. An aqueous sealing solution was prepared containing 100 ppm of $CrO_3$. The pH of the solution was 3.0. Separate specimens of each of the panels were sealed for 5,10, 15 and 20 minutes, respectively, while maintaining the bath temperature at 200° F. Coating adhesion tests and salt spray tests were then conducted and the percent hydration of the oxide layer was calculated. The results are set forth in Table 2 below. The test data indicates that all panels failed salt spray tests.

The sealing solution was then modified by adding 25 ppm of magnesium chromate ($MgCrO_4.4H_2O$), which altered the pH of this solution to 3.25. The solution temperature was maintained at 200° F. Separate test panels of each of the alloys were again sealed for 5, 10, 15 and 20 minutes, respectively. The coating adhesion and salt spray tests were subsequently run. The results are set forth in Table 2. With the slight increase in pH the 7075 alloy panels sealed for 15 or 20 minutes passed both tests, while the 2024 panel passed the salt spray test only when sealed for 20 minutes.

Three additional sealing solutions were then prepared containing 100 ppm $CrO_3$ and 50, 75 and 100 ppm of magnesium chromate, respectively. The pH of the solutions were respectively 3.38, 3.40 and 3.42. The temperature of the baths was maintained at 200° F. The sealing process was again repeated on panels of both alloys, and the coating adhesion test and salt spray test were again conducted. The results are all set forth in Table 2. Again, the slight increases in pH provided by the addition of magnesium chromate buffer increased the corrosion resistance of the panels.

TABLE 2

| Sealing Solution | pH | Temperature (°F.) | Time (min) | % Hydration 2024 −T3 | % Hydration 7075 −T6 | Coating Adhesion Test | 336 Hrs Salt Spray 2024 −T3 | 336 Hrs Salt Spray 7075 −T6 |
|---|---|---|---|---|---|---|---|---|
| 100 ppm | | | 5 | 4.7 | 3.1 | Pass | Fail | Fail |
| $CrO_3$ | 3.0 | 200 | 10 | 2.7 | 3.6 | Pass | Fail | Fail |
| | | | 15 | 2.1 | 3.6 | Pass | Fail | Fail |
| | | | 20 | 4.5 | 5.8 | Pass | Marginal | Marginal |
| 100 ppm | | | 5 | 3.8 | 3.4 | Pass | Fail | Fail |
| $Cr_3O$ | 3.25 | 200 | 10 | 5.7 | 6.7 | Pass | Fail | Fail |
| 25 ppm | | | 15 | 6.8 | 6.7 | Pass | Marginal | Pass |
| $MgCrO_44H_2O$ | | | 20 | 7.7 | 9.2 | Pass | Pass | Pass |
| 100 ppm | | | 5 | 4.2 | 3.1 | Pass | Fail | Fail |
| $CrO_3$ | 3.38 | 200 | 10 | 6.0 | 6.9 | Pass | Fail | Fail |
| 50 ppm | | | 15 | 8.5 | 9.9 | Pass | Pass | Pass |
| $MgCrO_44H_2O$ | | | 20 | 10.0 | 11.1 | Pass | Pass | Pass |
| 100 ppm | | | 5 | 4.2 | 4.5 | Pass | Fail | Pass |
| $CrO_3$ | | 200 | 10 | 3.4 | 4.4 | Pass | Pass | Pass |
| 75 ppm | 3.40 | | 15 | 6.2 | 6.7 | Pass | Pass | Pass |
| $MgCrO_44H_2O$ | | | 20 | 7.9 | 7.7 | Pass | Pass | Pass |
| 100 ppm | | | 5 | 2.0 | 4.2 | Pass | Fail | Fail |
| $CrO_3$ | | 200 | 10 | 7.4 | 2.7 | Pass | Pass | Marginal |
| 100 ppm | 3.42 | | 15 | 7.2 | 7.4 | Pass | Pass | Pass |
| $MgCrO_44H_2O$ | | | 20 | 8.7 | 11.7 | Pass | Pass | Pass |

EXAMPLE III

Another series of panels composed of 2024-T3 and 7075-T6 aluminum alloys were prepared. Specimens of each were anodized in accordance with the procedures outlined in Example I. An aqueous sealing solution was prepared containing 80 ppm $CrO_3$ and 25 ppm of sodium chromate ($Na_2CrO_4.4H_2O$). Separate specimens of each of the panels were sealed for 20, 25, 30 and 35 minutes in baths maintained at temperatures 185° F. and 195° F. and for 20 minutes at 205° F. Coating adhesion and salt spray tests were conducted. The pH of the 185° F. solution ranged from 3.2 to 3.6 and of the 195° F. solution from 3.2 to 3.6. The pH of the 205° F. solution was about 3.6. The results are set forth in Table 3.

It will be observed that all panels passed the coating adhesion test. However, those panels sealed for less than 35 minutes at 185° F. all failed the salt spray test. All remaining panels passed.

A new sealing solution was prepared containing 80 ppm $CrO_3$ and 50 ppm sodium chromate. Anodized test panels were again sealed at various times in 185° F., 195° F. and 205° F. baths. The results of the coating adhesion and salt spray tests are set forth in Table 3. All panels passed the coating adhesion and salt spray tests with the exception of those panel sealed for 20 minutes in the 185° F. bath.

In addition to the tests defined above, direct and reverse impact tests were performed in accordance with ASTM D2794 on an epoxy primer (equivalent to military specification MIL-P-2377) coated with an epoxy enamel (equivalent to military specification MIL-C-22750). The results of these tests corresponded to the test results set forth herein.

CONCLUSION

From the foregoing specification and examples, one of ordinary skill will readily understand that when the sealing process parameters set forth above are followed, a sealed aluminum oxide coating that exhibits both excellent saline corrosion resistance and organic coating adhesion. The present invention has therefore been so disclosed that one of ordinary skill will be able to make and use the invention. One of ordinary skill after reading the foregoing specification will also be able to effect various changes, alterations and substitutions of equivalents without departing from the broad concepts herein disclosed. It is therefore intended that the scope of Letters Patent issued hereon be limited only by the definition contained in the appended claims and equivalents thereof.

TABLE 3

| Sealing Solution | pH | Temperature (°F.) | Time (min) | % Hydration 2024 −T3 | % Hydration 7075 −T6 | Coating Adhesion Test | 336 Hrs Salt Spray 2024 −T3 | 336 Hrs Salt Spray 7075 −T6 |
|---|---|---|---|---|---|---|---|---|
| 80 ppm | 3.2 | 185 | 20 | 0 | 1.0 | Pass | Fail | Fail |
| $CrO_3$ | to | | 25 | 2.3 | 2.8 | Pass | Marginal | Marginal |
| 25 ppm | 3.6 | | 30 | 6.4 | 5.8 | Pass | Marginal | Marginal |
| $Na_2CrO_4$ | | | 35 | 6.8 | 6.5 | Pass | Pass | Pass |
| $4H_2O$ | 3.2 | 195 | 20 | 5.2 | 7.5 | Pass | Pass | Pass |
| | to | | 25 | 7.3 | 8.6 | Pass | Pass | Pass |
| | 3.6 | | 30 | 10.0 | 12.5 | Pass | Pass | Pass |
| | | | 35 | 8.4 | 8.1 | Pass | Pass | Pass |
| | 3.6 | 205 | 20 | 10.8 | 12.4 | Pass | Pass | Pass |
| 80 ppm | 3.4 | 185 | 20 | 1.9 | 2.4 | Pass | Fail | Fail |
| $CrO_3$ | to | | 25 | 0.8 | 3.9 | Pass | Pass | Pass |
| 50 ppm | 3.7 | | 30 | 11.8 | 10.6 | Pass | Pass | Pass |
| $Na_2CrO_4$ | | | 35 | 10.5 | 10.1 | Pass | Pass | Pass |
| $4H_2O$ | 3.4 | 195 | 20 | 9.5 | 9.9 | Pass | Pass | Pass |
| | to | | 25 | 10.9 | 11.9 | Pass | Pass | Pass |
| | 3.5 | | 30 | 13.1 | 13.1 | Pass | Pass | Pass |
| | | | 35 | 14.2 | 13.0 | Pass | Pass | Pass |
| | | 205 | 20 | — | — | Pass | Pass | Pass |

The embodiments of the invention in which an exclusive property or privilege is claimed are defined as follows:

1. A method for sealing a porous aluminum oxide film formed on an aluminum substrate to improve corrosion resistance and organic coating adhesion comprising:

contacting said film with a dilute aqueous sealing solution comprising an oxidizing composition comprising chromic acid, said oxidizing composition being present in said solution in an amount ranging from 20 to 200 ppm, all proportions herein being based on said total solution and being by weight, and a pH altering composition that maintains the pH of said solution in the range of from 3.2 to 4.0 selected from the group consisting of a buffering composition, a base or mixtures thereof, said film being in contact with said solution for from 5 to 60 minutes, said solution being maintained within a temperature range of from 160° F. to the boiling point of said solution.

2. The method of claim 1 wherein said base is selected from the group consisting of sodium hydroxide or ammonium hydroxide and wherein said buffering composition is selected from the group consisting of ammonium or alkali metal chromate, vanadate, molybdate or tungstate, or mixtures thereof.

3. The method of claim 1 wherein said buffering composition is selected from the group consisting of magnesium chromate, sodium chromate or mixtures thereof.

4. The method of claim 3 wherein hexavalent chromium ion is present in said solution in an amount ranging from 20 to 200 ppm, all proportions herein being based on said total solution.

5. The method of claim 4 wherein said hexavalent chromium ion is present in an amount ranging from 45 to 100 ppm.

6. The method of claim 3 wherein said chromic acid is present in the form of chromium trioxide in an amount ranging from 30 to 140 ppm.

7. The method of claim 6 wherein said chromic acid is present in the form of chromium trioxide in an amount ranging from 60 to 120 ppm.

8. The method of claim 6 wherein said buffering composition is present in an amount ranging from 20 to 200 ppm.

9. The method of claim 8 wherein said buffering composition is present in an amount ranging from about 25 to 100 ppm.

10. The method of claim 1 wherein said pH is maintained in the range of from about 3.2 to about 3.8.

11. The method of claim 1 wherein said predetermined time is in the range of from 20 to 30 minutes.

12. The method of claim 1 wherein the temperature of said solution is in the range of from 190° to 205° F.

13. The method of claim 1 wherein the total dissolved solids in said solutions is less than about 500 ppm.

14. The method of claim 13 wherein said total dissolved solids in said solution is less than about 250 ppm.

15. The method of claim 1 wherein the total oxidizing present in said solution ranges from about 20 to about 200 ppm.

16. The method of claim 14 wherein total pH altering composition is present in the range of from about 20 to about 200 ppm.

17. A method for sealing a porous aluminum oxide film formed on an aluminum substrate to improve corrosion resistance and organic coating adhesion comprising:

contacting said film with a dilute aqueous sealing solution comprising an oxidizing composition selected from the group consisting of molybdic acid, ammonium or alkali metal chromate or dichromate, ammonium or alkali metal vanadate, ammonium or alkali metal molybdate, ammonium or alkali metal tungstate, or mixtures thereof, and a pH altering composition that maintains the pH of said solution in the range of from 3.2 to 4.0, said film being in contact with said solution for from 5 to 60 minutes, said solution being maintained within a temperature range of from 160° F. to the boiling point of said solution.

18. The method of claim 17 wherein said pH altering composition comprises a strong acid.

19. The method of claim 18 wherein said strong acid comprises nitric acid.

* * * * *